US008376358B2

(12) United States Patent
deJong et al.

(10) Patent No.: US 8,376,358 B2
(45) Date of Patent: Feb. 19, 2013

(54) EXTENDED REGISTRATION CONTROL OF A SHEET IN A MEDIA HANDLING ASSEMBLY

(75) Inventors: Joannes N. M. deJong, Hopewell Junction, NY (US); Lloyd A. Williams, Mahopac, NY (US); Marina L. Tharayil, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/244,627

(22) Filed: Sep. 25, 2011

(65) Prior Publication Data

US 2012/0013066 A1 Jan. 19, 2012

Related U.S. Application Data

(63) Continuation of application No. 12/506,517, filed on Jul. 21, 2009, now Pat. No. 8,047,537.

(51) Int. Cl.
*B65H 7/02* (2006.01)

(52) U.S. Cl. ..... 271/228; 271/273

(58) Field of Classification Search ..... 271/227, 271/228, 273

See application file for complete search history.

(56) References Cited

U.S. PATENT DOCUMENTS

| | | | |
|---|---|---|---|
| 4,971,304 | A | 11/1990 | Lofthus |
| 5,169,140 | A | 12/1992 | Wenthe, Jr. |
| 5,219,159 | A | 6/1993 | Malachowski et al. |
| 5,278,624 | A | 1/1994 | Kamprath et al. |
| 5,322,273 | A | 6/1994 | Rapkin et al. |
| 5,678,159 | A | 10/1997 | Williams et al. |
| 5,681,036 | A | 10/1997 | Wakahara et al. |
| 5,697,608 | A | 12/1997 | Castelli et al. |
| 5,715,514 | A | 2/1998 | Williams et al. |
| 5,794,176 | A | 8/1998 | Milillo |
| 5,848,344 | A | 12/1998 | Milillo et al. |
| 5,994,711 | A | 11/1999 | Seachman et al. |
| 6,137,989 | A | 10/2000 | Quesnel |
| 6,168,153 | B1 | 1/2001 | Richards et al. |
| 6,173,952 | B1 | 1/2001 | Richards et al. |
| 6,181,153 | B1 | 1/2001 | Mahanpour |
| 6,373,042 | B1 | 4/2002 | Kretschmann et al. |
| 6,511,239 | B1 | 1/2003 | Kretschmann et al. |
| 6,533,268 | B2 | 3/2003 | Williams et al. |
| 6,817,609 | B2 | 11/2004 | Halvonik et al. |
| 6,836,627 | B2 | 12/2004 | Kretschmann et al. |
| 6,866,260 | B2 | 3/2005 | Williams et al. |
| 6,988,725 | B2 | 1/2006 | Rapkin |

(Continued)

FOREIGN PATENT DOCUMENTS

| | | |
|---|---|---|
| EP | 2058251 A2 | 5/2009 |
| JP | 10-120253 | 5/1998 |

OTHER PUBLICATIONS

European Search Report issued in European Patent Application No. 10169155.8 on Apr. 20, 2012.

*Primary Examiner* — Michael McCullough
(74) *Attorney, Agent, or Firm* — Hoffmann & Baron, LLP

(57) ABSTRACT

An apparatus including a sheet registration nip assembly for changing characteristics of the sheet with respect to the transport path. The characteristics of the sheet including a skew position, process direction position or a lateral position of the sheet. The registration nip assembly changing a first sheet characteristic to a first target characteristic by the time the sheet reaches a preliminary registration datum. A delivery registration datum disposed downstream of the registration nip assembly. The registration nip assembly changing a second sheet characteristic to a second target characteristic when at least a portion of the sheet is disposed along the transport path between the preliminary registration datum and the delivery registration datum. The apparatus including an auxiliary nip assembly disposed between the delivery registration datum and the registration nip assembly, wherein the preliminary registration datum is disposed between the delivery registration datum and the auxiliary nip assembly.

19 Claims, 6 Drawing Sheets

U.S. PATENT DOCUMENTS

| | | | |
|---|---|---|---|
| 7,293,769 | B2 | 11/2007 | Asari et al. |
| 2004/0046316 | A1 | 3/2004 | Tsuzawa |
| 2005/0035539 | A1 | 2/2005 | Hashimoto |
| 2006/0208416 | A1 | 9/2006 | Dejong et al. |
| 2008/0006992 | A1 | 1/2008 | Inoue |
| 2008/0073837 | A1 | 3/2008 | DeGruchy |
| 2009/0057994 | A1 | 3/2009 | Kondo |

EXTENDED REGISTRATION CONTROL OF A SHEET IN A MEDIA HANDLING ASSEMBLY

CROSS-REFERENCE TO RELATED APPLICATIONS

This application is a continuation of U.S. patent application Ser. No. 12/506,517 filed on Jul. 21, 2009, the disclosure of which is incorporated herein in its entirety by reference.

INCORPORATION BY REFERENCE

U.S. Pat. No. 7,731,188 issued Jun. 8, 2010, entitled "Sheet Registration System with Auxiliary Nips," and assigned to the assignee hereof is incorporated in its entirety for the teachings therein.

TECHNICAL FIELD

The presently disclosed technologies are directed to an apparatus and method used to provide control through extended correction of sheet lateral and skew positioning, as well as timing, in a media handling assembly such as a printing system.

BACKGROUND

In media handling assemblies, particularly in printing systems, accurate and reliable registration of the substrate media as it is transferred in a process direction is desirable. In particular, accurate registration of the substrate media, such as a sheet of paper, as it is delivered at a target time to an image transfer zone will improve the overall printing process. The substrate media is generally conveyed within the system in a process direction. However, often the position and/or timing of the substrate media can deviate from that which is intended or desired. The sheet might be ahead or behind in its process direction position, or the sheet can shift in a cross-process direction (lateral to the process direction) or even acquire an angular orientation (referred herein as "skew") such that the opposed linear edges are no longer parallel to the process direction. Thus, there are three degrees of freedom in which the substrate media can move, which need to be controlled in order to achieve accurate delivery thereof. A slight skew, lateral misalignment or error in the arrival time of the substrate media through a critical processing phase can lead to errors, such as image and/or color registration errors relating to arrival at an image transfer zone. Also, as the substrate media is transferred between sections of the media handling assembly, the amount of registration error can increase or accumulate. A substantial skew and/or registration error can cause pushing, pulling or shearing forces to be generated, which can wrinkle, buckle or even tear the sheet.

Contemporary systems transport a sheet and deliver it at a target time to a "datum," based on positional measurements from the sheet. That datum, also referred to herein as a delivery registration datum, can be a particular point in a transfer zone, a hand-off point to a downstream nip assembly or any other target location within the media handling assembly. Typically, the time and orientation of the sheet arriving in a sheet registration system is measured by sensors located near the input of the registration system. A controller then computes a sheet velocity command profile designed to deliver the sheet at a target time that delivery registration datum. A sheet velocity actuator commanded by the controller then executes a command profile in order to timely and accurately deliver the sheet. Examples of typical sheet registration and deskewing systems are disclosed in U.S. Pat. Nos. 5,094,442, 6,533,268, 6,575,458 and 7,422,211, commonly assigned to the assignee of record herein, namely Xerox Corporation, the disclosures of which are each incorporated herein by reference. While these systems particularly relate to printing systems, similar paper handling techniques apply to other media handling assemblies.

Such contemporary systems attempt to achieve position registration of sheets by separately varying the speeds of laterally spaced apart drive rollers in registration nip assemblies to correct for skew mispositioning of the sheet, which is also referred to as differentially driven drive or nip assemblies, such as that disclosed in U.S. Pat. No. 7,422,211. By imparting specific differential drive velocity profiles to the two drive nips over a small period of time, skew, process direction and/or lateral position of the sheet can also be corrected. Separate drive motors and/or belt assemblies are often included in differential drive systems, for imparting an angular velocity to the driven wheels. While each motor may be connected directly to the driven wheels, belts (also referred to as timing belts) are often employed. Also, the motors may be stepper motors or DC servo motors with encoder feedback from an encoder mounted on the motor shaft, a driven wheel shaft or the idler shaft. Such registration nip assemblies also generally includes sheet sensors, which are used to detect the arrival of a sheet, its lateral position, skew and other characteristics. Temporarily driving the laterally spaced nips at slightly different rotational speeds will produce a slight difference in the total rotation or relative pitch position of each drive roll while the sheet is held in the two nips. In this way, one side of the sheet moves ahead of the other to induce skew (small partial rotation) in the sheet, in order to eliminate and/or correct for detected skew or positional errors in the lateral or process directions.

Alternatively, contemporary systems include a translating carriage on which the registration nip assemblies are mounted, such as that disclosed in U.S. Pat. No. 5,094,442. As shown in FIG. 6, a nip assembly 2 includes a driven wheel 6 (also referred to as a drive roll) and an idler wheel 8, (also referred to as an idler roll) which together engage opposed sides of the sheet S and conveying it within the printing system in a process direction P. The system includes two laterally spaced apart nip assemblies 2 that are together mounted on a carriage 40. The carriage 40 is able to translate laterally with the use of a separate motor 42 and screw drive shaft 44, as well as a carriage guide collars 46 slideable along a carriage guide shaft 48. The motor 42 turns the screw drive shaft 44, which then translates the carriage 40 laterally, along with the nip assembly 2. In this way, as the carriage 40 with the nip assembly 2 translates laterally, so does the sheet S.

Further sheet registration systems are disclosed in U.S. Pat. Nos. 5,697,608 and 6,866,260, commonly assigned to the assignee of record herein, namely Xerox Corporation, the disclosures of which are each incorporated herein by reference. Such systems use a pair of sheet edge sensors, located on one side of the sheet path, to measure the position of a sheet upon arrival in the sheet registration nip assembly. One of the two edge sensors is generally located laterally adjacent or just upstream of the registration nip assembly, with the other edge sensor disposed further upstream. In this way, when the sheet arrives at the registration nip assembly, the differential measurements from the two edge sensors can be used to calculate lateral position and skew of the sheet. This information is then fed to a controller, which in turn signals the registration nip assembly in order properly register the sheet position laterally and in skew. Typically, the controller calculates the correction of the sheet lateral and skew position to be completed prior to each sheet's arrival at the downstream delivery registration datum. That earlier point for completion of the registration correction is a virtual registration datum that lies somewhere between the registration nip assembly and the delivery registration datum. However, often a sheet can arrive at the virtual registration datum with its registration not fully corrected. Also, further registration errors can occur as the sheet travels from the virtual registration datum to the delivery registration datum.

Accordingly, it would be desirable to provide a method and apparatus capable of more accurately registering a sheet in a media handling assembly, which overcomes the shortcoming of the prior art.

SUMMARY

According to aspects described herein, there is disclosed an apparatus for registering a sheet moved in a process direction along a transport path in a media handling assembly. A lateral direction extending perpendicular to the process direction. The apparatus includes a sheet registration nip assembly and a controller. The sheet registration nip assembly changes characteristics of the sheet with respect to the transport path. The characteristics of the sheet including at least a skew, process direction and/or a lateral position of the sheet. The controller communicating a first signal to the sheet registration nip assembly to change a first sheet characteristic to a target characteristic. The first signal generated to impart the target characteristic to the sheet by the time the sheet reaches a preliminary registration datum. The preliminary registration datum disposed along the transport path between the sheet registration nip assembly and a delivery registration datum. The delivery registration datum disposed downstream of the sheet registration nip assembly. The controller communicating a second signal to the sheet registration nip assembly to change a second sheet characteristic to the target characteristic. The second signal communicated when at least a portion of the sheet is disposed along the transport path between the preliminary registration datum and the delivery registration datum.

Additionally, a first sensor for measuring characteristics of the sheet at a first point along the transport path can be provided. The first point being disposed substantially upstream along the transport path of the sheet registration nip assembly. The first sensor can communicate the first sheet characteristic to the controller. Also, a second sensor for measuring characteristics of the sheet at a second point along the transport path can be provided. The second sensor measuring a portion of the sheet disposed downstream along the transport path of the sheet registration nip assembly. The second sensor can communicate the second sheet characteristic to the controller. Also, an auxiliary nip assembly can be disposed laterally adjacent the second sensor, with the preliminary registration datum being coincident with the second point. Further, the apparatus can include an auxiliary nip assembly disposed between the delivery registration datum and the sheet registration nip assembly. The preliminary registration datum can be disposed between the sheet registration nip assembly and the auxiliary nip assembly. Further still, the apparatus can include an auxiliary nip assembly disposed between the delivery registration datum and the sheet registration nip assembly. The preliminary registration datum can be disposed between the delivery registration datum and the auxiliary nip assembly. Yet further still, the auxiliary nip assembly can move into an open position in response to the second signal being communicated. The second signal can indicate a length of the sheet exceeds a predetermined value. Also, the auxiliary nip assembly can move into a closed position subsequent to the second signal being communicated. Alternatively, the auxiliary nip assembly can move into a closed position coincident with a trailing edge of the sheet passing the sheet registration nip assembly. What is more, the delivery registration datum can coincide with a sheet capture point of a next downstream transfer station.

According to other aspects described herein, there is provided a method of registering a sheet moved substantially in a process direction along a transport path in a media handling assembly. The method includes receiving first sheet characteristic information, wherein sheet characteristic information includes at least one of a skew and a lateral position of the sheet relative to a sheet registration nip assembly. The method also including transmitting a first signal to the sheet registration nip assembly to change the first sheet characteristic to a target characteristic. The first signal generated to impart the target characteristic to the sheet by the time the sheet reaches a preliminary registration datum. The preliminary registration datum disposed along the transport path between the sheet registration nip assembly and a delivery registration datum. The delivery registration datum being disposed downstream of the sheet registration nip assembly. Also, the method including receiving a second sheet characteristic information, the second sheet characteristic information being received after at least a portion of the sheet is disposed along the transport path between the preliminary registration datum and the delivery registration datum. Further, the method including transmitting a second signal to the sheet registration nip assembly to change a second sheet characteristic to the target characteristic.

Additionally, as part of the method the first signal can be received from a first sensor for measuring characteristics of the sheet at a first point along the transport path. At the first point, the sheet can be disposed substantially upstream along the transport path of the sheet registration nip assembly. The second signal can be received from a second sensor for measuring characteristics of the sheet at a second point along the transport path. The second point can be disposed downstream along the transport path of the sheet registration nip assembly. Also, the first signal can be generated to impart the target characteristic to the sheet by the time the sheet reaches the delivery registration datum. The method can also include transmitting a third signal, thereby actuating the auxiliary nip assembly to move into an open position in response to the second signal being transmitted. The second signal can indicate a length of the sheet exceeds a predetermined value. Further, the method can include transmitting a third signal thereby actuating the auxiliary nip assembly to move into a closed position in response to the second signal being transmitted. The third signal can be transmitted to actuate the auxiliary nip assembly to move into a closed position in response to a trailing edge of the sheet passing the sheet registration nip assembly. Also, the delivery registration datum can coincide with a sheet capture point of a next downstream transfer station.

These and other aspects, objectives, features, and advantages of the disclosed technologies will become apparent from the following detailed description of illustrative embodiments thereof, which is to be read in connection with the accompanying drawings.

DETAILED DESCRIPTION

Figure 1:
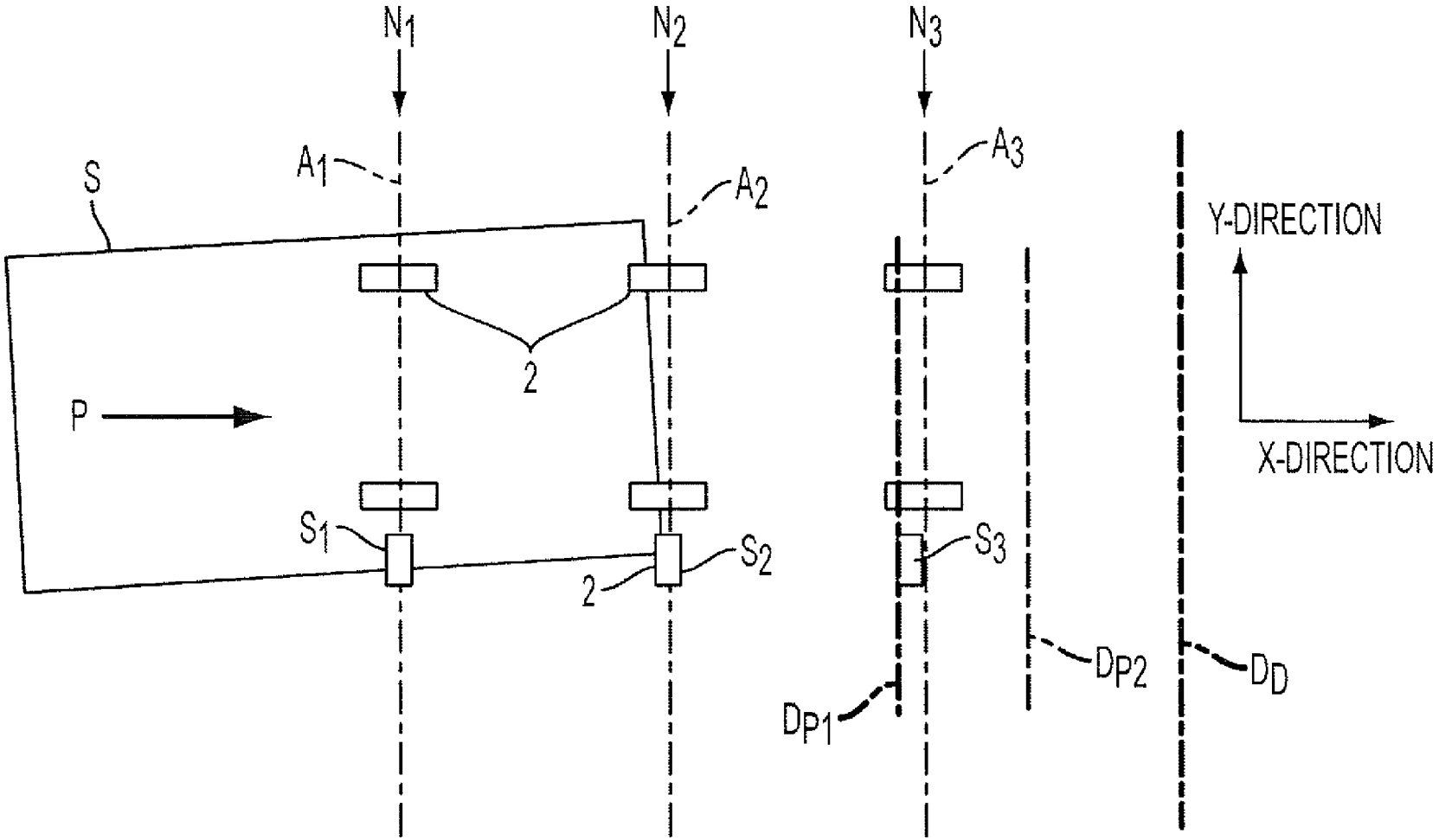
FIG. 1 is a schematic plan view of a system for registering a sheet in a media handling assembly in accordance with an aspect of the disclosed technologies.

Describing now in further detail these exemplary embodiments with reference to the Figures, as described above the accurate sheet leading edge registration system and method are typically used in a select location or locations of the paper path or paths of various conventional media handling assemblies. Thus, only a portion of an exemplary media handling assembly path is illustrated herein.

As used herein, a "printer," "printing assembly" or "printing system" refers to one or more devices used to generate "printouts" or a print outputting function, which refers to the reproduction of information on "substrate media" for any purpose. A "printer," "printing assembly" or "printing system" as used herein encompasses any apparatus, such as a digital copier, bookmaking machine, facsimile machine, multi-function machine, etc. which performs a print outputting function.

A printer, printing assembly or printing system can use an "electrostatographic process" to generate printouts, which refers to forming and using electrostatic charged patterns to record and reproduce information, a "xerographic process", which refers to the use of a resinous powder on an electrically charged plate record and reproduce information, or other suitable processes for generating printouts, such as an ink jet process, a liquid ink process, a solid ink process, and the like. Also, such a printing system can print and/or handle either monochrome or color image data.

As used herein, "substrate media" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any substrate media in the form of a sheet amounts to a reasonable equivalent thereto. Also, the "leading edge" of a substrate media refers to an edge of the sheet that is furthest downstream in the process direction.

As used herein, a "media handling assembly" refers to one or more devices used for handling and/or transporting substrate media, including feeding, printing, finishing, registration and transport systems.

As used herein, "sensor" refers to a device that responds to a physical stimulus and transmits a resulting impulse for the measurement and/or operation of controls. Such sensors include those that use pressure, light, motion, heat, sound and magnetism. Also, each of such sensors as refers to herein can include one or more point sensors and/or array sensors for detecting and/or measuring characteristics of a substrate media, such as speed, orientation, process or cross-process position and even the size of the substrate media. Thus, reference herein to a "sensor" can include more than one sensor.

As used herein, a "nip," "nips," a "nip assembly" or "nip assemblies" refers to an assembly of elements that include at least two adjacent rolls and supporting structure, where the two adjacent rolls are adapted to matingly engage opposed sides of a substrate media. One of the two rolls can include a driven wheel, while at least one of the two rolls is a freely rotating idler wheel. Together the two rolls guide or conveying the substrate media within a media handling assembly. More than two sets of mating rolls can be provided in a laterally spaced configuration to form a nip assembly.

As used herein, "skew" refers to a physical orientation of a substrate media relative to a process direction. In particular, skew refers to a misalignment, slant or oblique orientation of an edge of the substrate media relative to a process direction.

As used herein, the terms "process" and "process direction" refer to a process of moving, transporting and/or handling a substrate media. The process direction is a flow path the substrate media moves in during the process. A "cross-process direction" is perpendicular to the process direction and generally extends parallel to the web of the substrate media.

FIG. 1 depicts a schematic plan view of a system for registering a sheet handled in a printing system. It should be noted that the schematic drawings herein are not to scale. In FIG. 1, arrow P represents the primary direction of flow of the sheet S, which corresponds to the process direction, from an upstream location toward a downstream location. In this way, the sheet generally travels across nip assemblies $N_1$, $N_2$, $N_3$. While three nip assemblies $N_1$, $N_2$, $N_3$ are shown, each with a respective center axis of rotation $A_1$, $A_2$, $A_3$, a greater or fewer number of such sets of nip assemblies can be provided. Also, the nip assemblies could include more than two nips 2 laterally spaced along each axis of rotation $A_1$, $A_2$, $A_3$. As shown, the process direction P runs parallel to the x-axis, while the lateral or cross-process direction runs parallel to the y-axis, which is perpendicular to the x-axis. The second nip assembly $N_2$ is illustrated as the registration nip assembly. Such a registration nip assembly $N_2$ can include a differential drive system and/or a translating carriage assembly, as described above, for correcting and/or controlling sheet registration. The other two nip assemblies $N_1$, $N_3$ are at least guide nips, with opposed rollers that are biased toward one another, without one of them being a driven wheel. Alternatively, the additional nip assemblies $N_1$, $N_3$ can include a driven wheel.

Additionally, provided are lateral edge sensors $S_1$, $S_2$, $S_3$. As described above with regard to contemporary sheet registration systems, the first two sensors $S_1$, $S_2$ are used to detect the orientation of the sheet S as it approaches and is engaged by the registration nip assembly $N_2$. By placing the sensor $S_2$ laterally adjacent to or slightly upstream relative to nip assembly $N_2$, the arrival at the position of the sensor $S_2$ in the process direction can also be associated with the point where the sheet $S_2$ is at least partially engaged by the nip assembly $N_2$. The second sensor $S_2$ can alternatively be position slightly downstream of the nip assembly $N_2$ in order to guarantee that arrival at that sensor S means the sheet is engaged within the appropriate nips 2. Once the presence of the sheet S is detected, the registration nip assembly $N_2$ only has a limited time of engagement with that sheet S in which to manipulate and/or adjust its position. Thus, while it is desirable to place the sensor $S_2$ as close as possible in the process direction to the registration nip assembly $N_2$, such a sensor could be positioned closer or further from the nip as desired for a particular application. Also, the sensor $S_2$ could potentially be positioned on the downstream side of the registration nip assembly $N_2$. In accordance with an aspect of the disclosed technologies, the third edge sensor $S_3$ is provided downstream of nip assembly $N_2$ for extended registration control.

While three single edge sensors $S_1$, $S_2$, $S_3$ are shown, it should be understood that fewer or greater numbers of sensors could be used, depending on the type of sensor, the desired accuracy of measurement and redundancy needed or preferred. For example, a pressure or optical sensor could be used to detect when the lateral edge of the sheet passes over each individual sensor. Additionally, the sensors can be positioned further upstream or closer to one another as necessary. It should be appreciated that any sheet sensing system can be used to detect the positional characteristics of the substrate media in accordance with the disclosed technologies. By measuring the sheet S lateral position at the sensors $S_1$, $S_2$ and knowing the spacing between the sensors $S_1$, $S_2$, skew of the sheet S relative to the nip assembly $N_2$ can be calculated, as is known in the art. Alternatively, a similar skew orientation of the sheet S can be detected by other sensor systems, disposed upstream of the nip assembly $N_2$. For example, a pair of point sensors, such as leading edge sensors, or one or more array sensors capable of measuring process speed and lateral and skew position can alternatively be provided. Similarly, while a single downstream sensor $S_3$ is shown, additional or different sensors could be used for detecting and measuring downstream sheet positional characteristics.

In accordance with an aspect of the disclosed technologies, a preliminary registration datum $D_{P1}$ is established upstream of the delivery registration datum $D_D$. The delivery registration datum $D_D$ is generally associated with a particular point in a transfer zone, a hand-off point to a downstream nip assembly or any other target location within the media handling assembly. In contrast, the preliminary registration datum $D_{P1}$ is a virtual point along the sheet path P, prior to the delivery registration datum $D_D$, used by a system controller for calculating and timing sheet registration correction. In this way, sheet registration errors are corrected by the time the sheet S reaches the preliminary registration datum $D_{P1}$, which is before it reaches the delivery registration datum $D_D$. In one embodiment, the preliminary registration datum $D_{P1}$ is disposed in close proximity to auxiliary nip assembly $N_3$, with the auxiliary nip assembly $N_3$ being disposed downstream of the registration nip assembly $N_2$, but upstream of the delivery registration datum $D_D$. In an alternative embodiment, the preliminary registration datum $D_{P2}$ is disposed closer to the delivery registration datum $D_D$, which in the embodiment shown is downstream of the auxiliary nip assembly $N_3$. While the preliminary registration datum $D_{P1}$, $D_{P2}$ are illustrated in particular positions along the process path P, it should be understood that a preliminary registration datum could be designed to lie almost anywhere downstream of the registration nip assembly, but before the actual delivery registration datum $D_D$. A consideration in designing the position of the preliminary registration datum is to allow sufficient distance/time for the registration nip assembly $N_2$ to correct for registration errors in a sheet by the time it reaches that point in the path. Similarly, in accordance with an aspect of the instant disclosed technologies, sufficient distance/time should remain for further registration correction between the preliminary registration datum and the delivery datum $D_D$.

FIGS. 2-5 depict a schematic elevation view of a system similar to that of FIG. 1, but with the first upstream edge sensor and associated nip assemblies not shown. It should be noted that while the more upstream sensor $S_1$ is not shown, it would normally be disposed to the left of the second edge sensor $S_2$, relative to the view shown in these schematic elevation views. Also, if an initial upstream nip assembly $N_1$ is included, which is optional, it too would be located to the left of the system shown.

Figure 2:
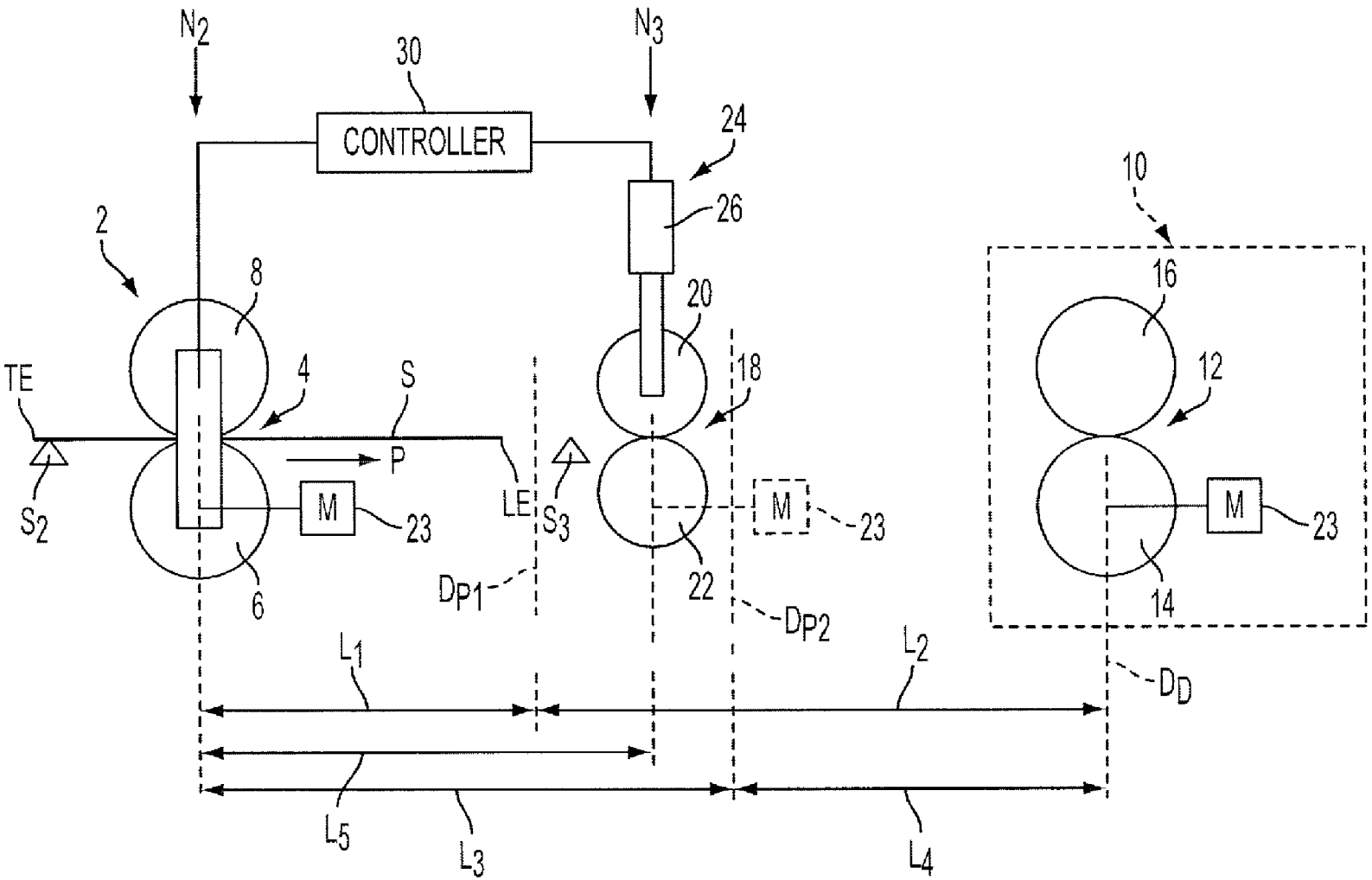
FIG. 2 is a schematic elevation view of a system for registering a sheet engaged in a sheet registration nip assembly in accordance with an aspect of the disclosed technologies.

In FIG. 2, the sheet S is fully engaged by the registration nip assembly $N_2$ and has progressed along the process path P, such that its leading edge LE has passed the registration nips 2, but the sheet trailing edge TE remains up of the registration nips 2. Each of the registration nips 2, includes a drive roll 6 and a mating idler roll 8, with elements biasing one or both rolls 6, 8 toward one another. In this way, the sheet S is frictionally engaged in the nip gap 4 between the mating rolls 6,8. The drive roll 6 is driven by a motor assembly 23 in order to turn the drive roll 6 and convey the sheet S along the path P. The operation of registration nip assembly $N_2$, including the drive rolls 6 and motor 23, is proscribed by a controller 30. Once the sheet S is engaged in the nip assembly $N_2$, and the positional and velocity characteristics of the sheet S have been measured, the controller 30 can communicate signals to effect any necessary registration correction operations.

Generally, in order to correct improper sheet registration, the registration device can move the sheet or alter the sheet's movement in up to three degrees of freedom (x, y and rotational movement). Based on the configuration of the overall apparatus and characteristics of the sheet S, such as sheet length, speed and orientation, the controller 30 uses a predefined point along the process path P in which to complete the desired registration correction. Such a predefined correction point is referred to herein as a "preliminary registration datum." In contemporary systems, once the sheet has reached such a preliminary registration datum, any remaining or subsequently generated errors in sheet registration go uncorrected prior to the sheet's arrive at the delivery datum. In accordance with an aspect of the disclosed technologies, the additional downstream sensor $S_3$ can be used to detect unresolved or subsequent registration errors. For example, as previously discussed with regard to the first two sensors $S_1$, $S_2$, the downstream sensor $S_3$ can be used in combination with the second sensor $S_2$ in order to determine sheet characteristics, such as position, orientation and speeds. While the sheet remains engaged within the registration nip assembly $N_2$ the controller 30 can initiate further corrections to the registration of the sheet S.

A controller 30 is used to receive sheet information from lateral edge sensors $S_1$, $S_2$, $S_3$ and any other available input that can provide useful information regarding the sheet(s) being handled in the system. The controller 30 can include one or more processing devices capable of individually or collectively receiving signals from input devices, outputting signals to control devices and processing those signals in accordance with a rules-based set of instructions. The controller 30 can then transmit signals to one or more actuation systems, such as a process, lateral or skew adjustment system as discussed above with regard to the prior art.

The illustrations herein show two examples of preliminary registration datum located at different distances from the registration nip assembly $N_2$. The first preliminary registration datum $D_{P1}$ is disposed a distance $L_1$ from the center axis $A_2$ of the registration nip assembly $N_2$. Thus, the controller 30 can use the distance $L_1$ in determining how quickly it must direct the sheet S to be adjusted in order for it to arrive at the preliminary registration datum $D_{P1}$ with a corrected registration. Alternatively, a different predefined correction point, such as preliminary registration datum $D_{P2}$, can be used allowing the controller 30 a longer distance $L_3$ in which to complete the registration correction. While the decision on where to locate the preliminary registration datum can be arbitrary, the length of the sheet being handled by the system, as well as the desired skew measurement accuracy, can influence this decision. Once the leading edge LE of the sheet S has reached the preliminary registration datum $D_{P1}$, $D_{P2}$ a supplemental closed loop registration control can occur over the remaining respective distances $L_2$, $L_4$. The controller 30 can therefore continue to direct movements of the sheet S until either the trailing edge TE of the sheet leaves the registration nip assembly $N_2$ or the sheet leading edge LE reaches the delivery registration datum $D_D$.

The delivery registration datum $D_D$ can be coincident with an exemplary downstream receiving station 10. The receiving station 10 is shown including a set of receiving nips, which include a drive roll 14, an idler roll 16 and a suitable motor drive 23 for driving the drive roll 14. The drive roll 14 and idler roll 16 being designed, as with the previously discussed nips 2 to engage the sheet S in a nip gap 12 there between. In should be understood that while the delivery registration datum $D_D$ is illustrated as being part of a receiving station 10 with nips, such is not necessary. The receiving station 10 could capture the sheet S by some other mechanism or simply provide a location for image transfer to the sheet S, such as with a photoreceptor. The receiving station 10 is merely intended to schematically represent a downstream point to which a registered sheet is to be fed.

In the embodiment shown, an auxiliary nip assembly $N_3$ is included downstream of the registration nip assembly $N_2$, but upstream of the delivery registration datum $D_D$. Preferably, the distance $L_5$ between the registration nip assembly $N_2$ and the auxiliary nip assembly $N_3$ is at least slightly less than the length of the shortest sheet S that is intended to be handled in the apparatus. Similarly, the remaining distance between the auxiliary nip assembly $N_3$ and the delivery registration datum $D_D$ should either be less than the shortest sheet length or alternatively additional auxiliary nips could be provided along the path P. In an embodiment where no auxiliary nip assembly $N_3$ is included, then preferably the distance between the registration nip assembly $N_2$ and the delivery registration datum $D_D$ is less than the shortest sheet length. As with the registration nip assembly $N_2$, the auxiliary nip assembly $N_3$ can including opposed rolls 20, 22 that can be biased toward one another for engaging the sheet S in the nip gap 18 there between. Alternatively, auxiliary nip assembly $N_3$ can include a suitable motor assembly 23 for driving one of the rolls, such as the lower roll 22.

A further aspect of the disclosed technologies herein involves the auxiliary nip assembly $N_3$ being moveable between an open and closed position. In a closed position, the rolls 20, 22 of the auxiliary nip assembly $N_3$ are biased for engaging opposed sides of a sheet S passing therethrough. In an open position the rolls 20, 22 are spaced apart and a sheet S may pass through unobstructed. Any type of suitable actuator 24 may be used to move at least one of the rolls 20, 22 between the open and closed positions. For example as shown, the upper roll 20 can be actuated by a solenoid 26. Alternatively, an arrangement similar to that shown in U.S. Pat. No. 6,168,153, 6,173,952 or 6,817,609 may be used. As disclosed in those patents, a cam assembly can be used to lift and disengage the upper roll 20 from its mating lower roll 22. Preferably, such an actuator 24 is coupled to and directed by the controller 30, which can send signals to the actuator 24 to initiate the opening or closing thereof. It should be noted that the upstream nip assembly $N_1$, although not shown in detail, can be similar to auxiliary nip assembly $N_3$, with or without a motor driven drive roll. Also, the nip assemblies described herein need not all have the same features, capabilities or functions.

Figure 3:
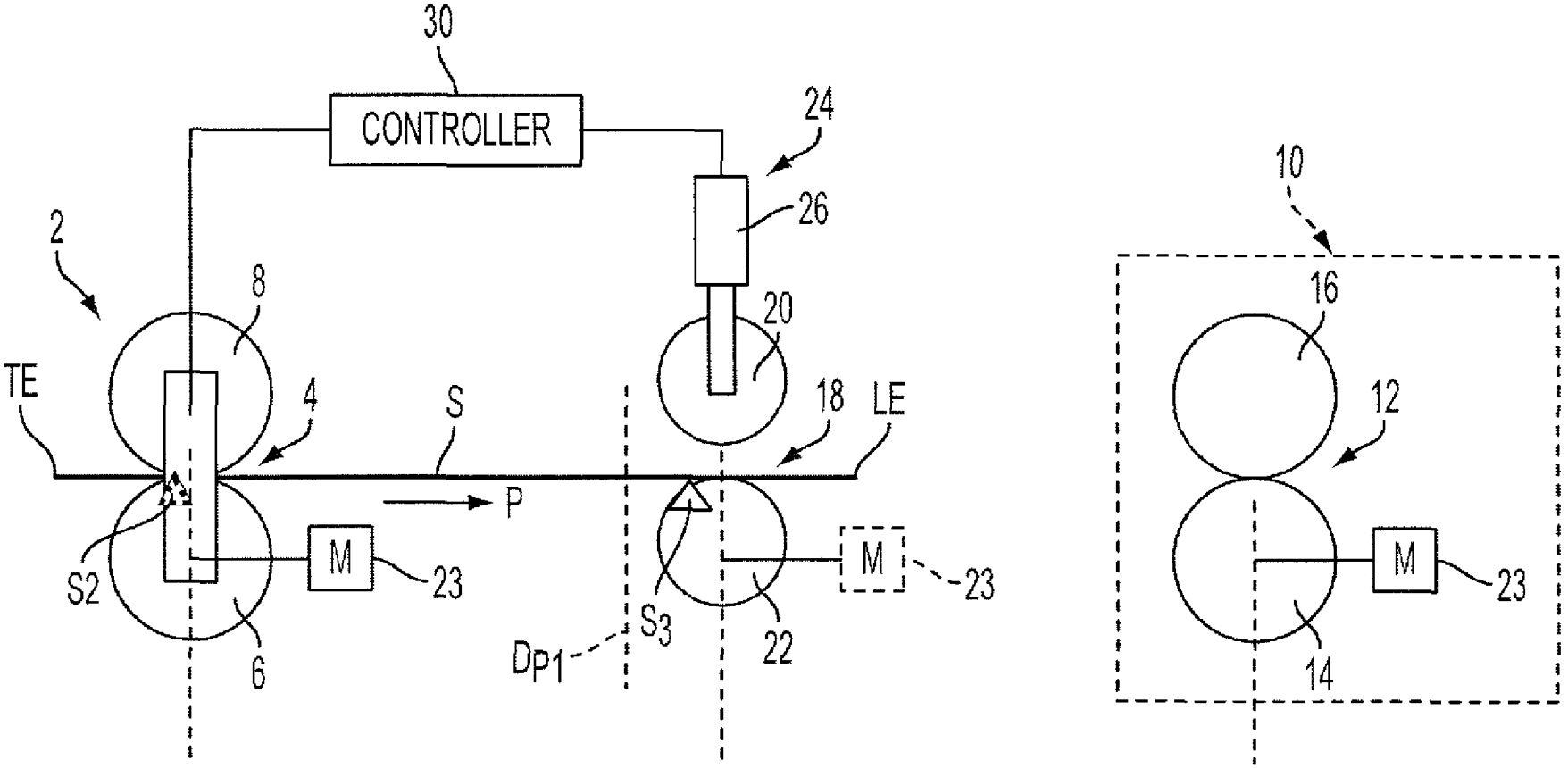
FIG. 3 is a view similar to FIG. 2, but with the sheet having reached an auxiliary nip assembly and the auxiliary nip assembly in an open position.
Figure 4:
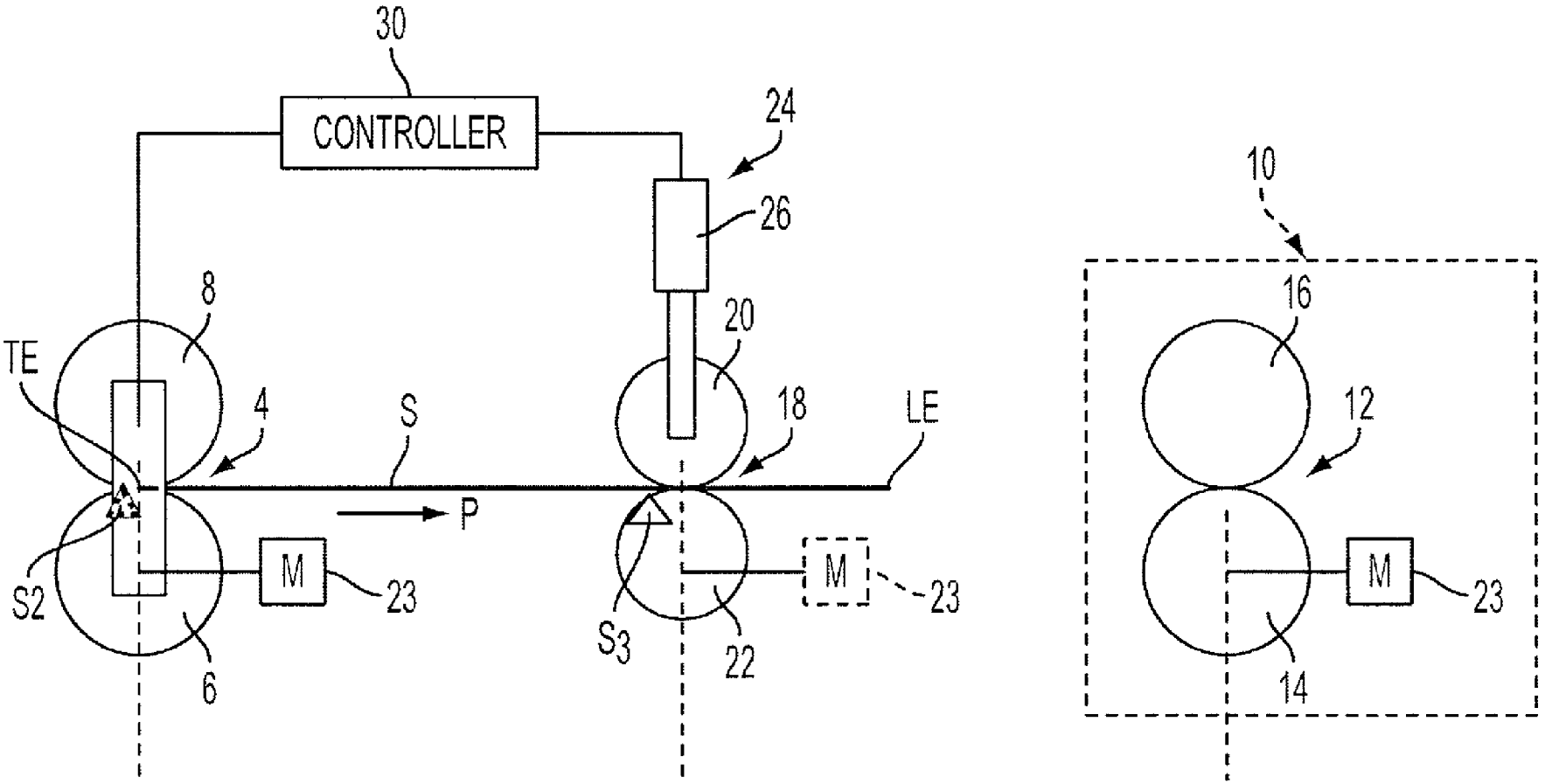
FIG. 4 is a view similar to FIG. 3, but with a trailing edge of the sheet passing the sheet registration nip assembly and the auxiliary nip assembly in a closed position.
Figure 5:
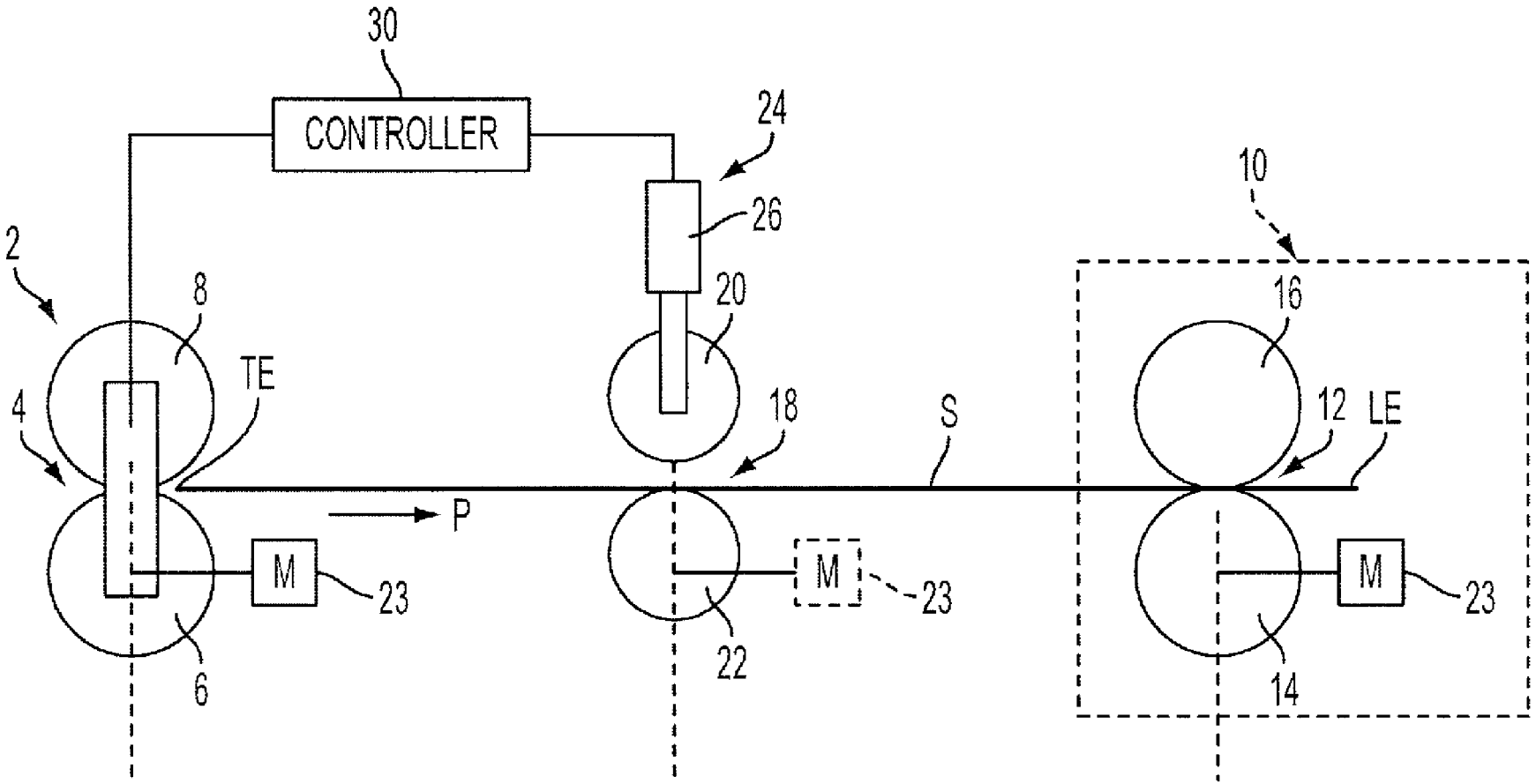
FIG. 5 is a view similar to FIG. 3, but showing a longer sheet being fed through the media handling assembly in accordance with an aspect of the disclosed technologies.
Figure 6:
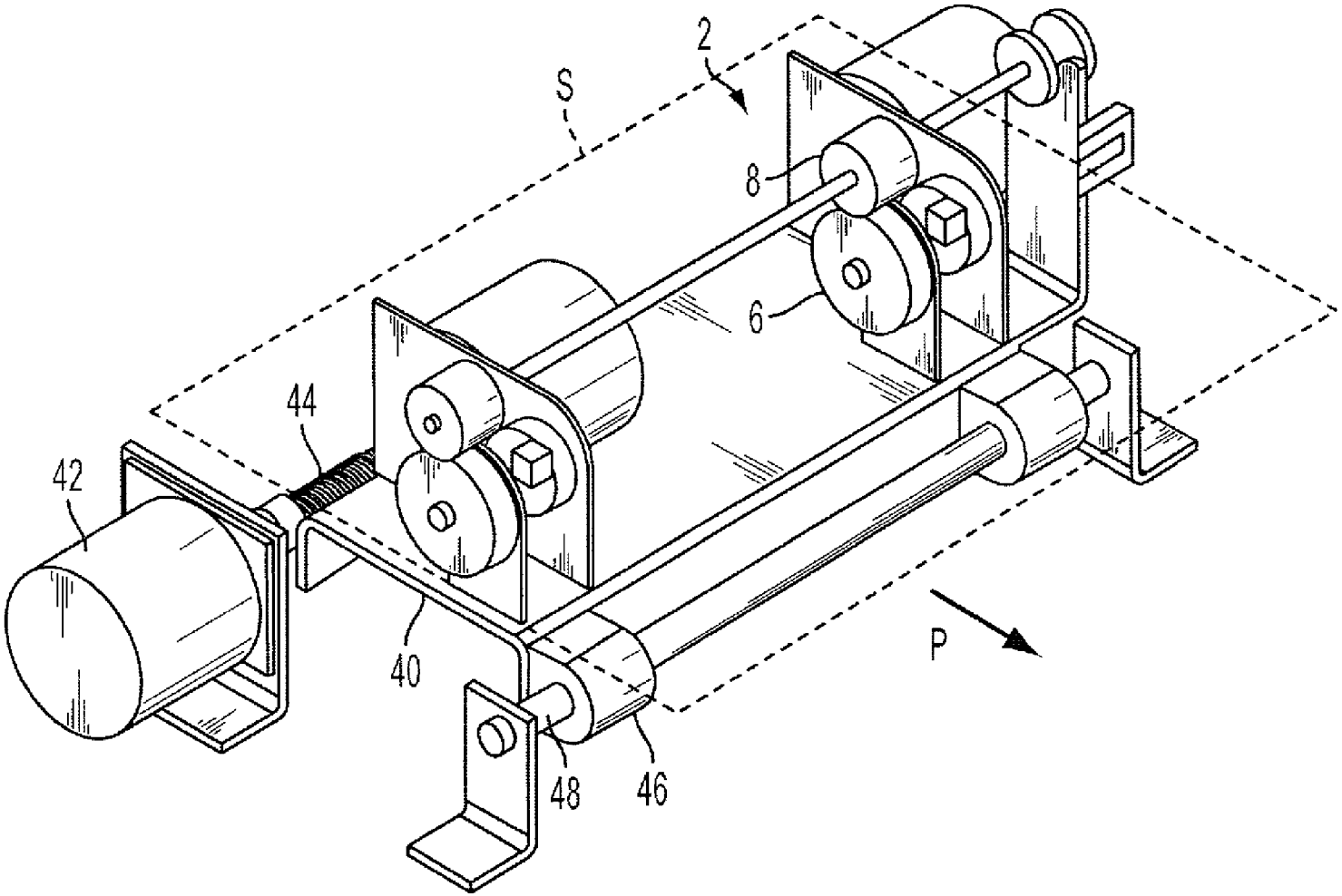
FIG. 6 PRIOR ART
FIG. 6 shows a prior art sheet registration assembly including a laterally translating nip assembly carriage.

In operation, the nip assemblies $N_1$, $N_3$ not used for registration can be opened in order to allow the registration nip assembly $N_2$ to freely adjust sheet velocities and/or orientation, as shown for example in FIG. 3 with regard to auxiliary nip assembly $N_3$. In order to correct sheet registration errors, it is preferable that the any upstream or downstream nip assemblies $N_1$, $N_3$ be in an open position. Thus, as shown in FIG. 3, even though the sheet S has traveled beyond the preliminary registration datum $D_{P1}$, since the sheet S is still engaged by the registration nip assembly $N_2$, further closed loop registration correction can be commanded by the controller 30. If the length of the sheet S is shorter than the distance between the registration nip assembly $N_2$ and the delivery registration datum $D_D$, then the auxiliary nip assembly $N_3$ should be moved to a closed position just before the trailing edge TE of the sheet S exits the registration nip assembly $N_2$, as shown in FIG. 4. Also, based on the sheet length shown in FIG. 4 relative to the assembly, in an embodiment where the auxiliary nip assembly $N_3$ is provided with a motor drive assembly or registration correction capability, if further registration errors are noted after the sheet has been released from registration nip assembly $N_2$, then the auxiliary nip assembly $N_3$ could be used to continue closed loop registration correction. Alternatively, when handling a longer sheet S as shown in FIG. 5, the auxiliary nip assembly $N_3$ need not be closed. It should be understood that the "normal" or default position for the auxiliary nip assembly $N_3$ can either in an open or closed position, as desired.

A sheet length control signal can be provided to the controller 30, which indicates the length of the actual sheet S being handled by the apparatus. The sheet length control signal can be received by the controller 30 from one or more separate sensors dedicated to this measurement or the same sensor(s) used for measuring sheet velocities and orientation. Alternatively, the sheet length control signal can be input by an operator, automatically provided by a sheet feeding tray or other assembly selection. Such a sheet length measurement can be used for designating the location of the preliminary registration datum discussed above.

Often media handling assembly, and particularly printing systems, include more than one module or station. Accordingly, more than one registration apparatus as disclosed herein can be included in an overall media handling assembly. Further, it should be understood that in a modular system or a system that includes more than one registration apparatus, in accordance with the disclosed technologies herein, could detect sheet position or other sheet characteristics and relay that information to a central processor for controlling registration, including errors in process, lateral or skew positioning within the overall media handling assembly. Thus, if the registration error is too large for one registration system to correct, then correction can be achieved with the use one or more subsequent downstream registration systems, for example in another module or station.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus for registering a sheet moved in a process direction along a transport path in a media handling assembly, a lateral direction extending perpendicular to the process direction, the apparatus comprising:

a sheet registration nip assembly for changing characteristics of the sheet with respect to the transport path, the characteristics of the sheet including at least one of a skew position, process direction position and a lateral position of the sheet, the sheet registration nip assembly changing a first sheet characteristic to a first target characteristic by the time the sheet reaches a preliminary registration datum, a delivery registration datum being disposed downstream of the sheet registration nip assembly, the sheet registration nip assembly changing a second sheet characteristic to a second target characteristic when at least a portion of the sheet is disposed along the transport path between the preliminary registration datum and the delivery registration datum;

an auxiliary nip assembly disposed between the delivery registration datum and the sheet registration nip assembly, wherein the preliminary registration datum is disposed between the delivery registration datum and the auxiliary nip assembly an element biasing the auxiliary nip assembly selectively into one of an open and a closed position;

a first sensor measuring the first sheet characteristic at a first point along the transport path, the first sensor emitting a first signal; and a second sensor measuring the second sheet characteristic at a second point along the transport path, wherein a second signal from one of the first and second sensors indicates a length of the sheet exceeds a predetermined value.

2. The apparatus of claim 1, further comprising:

the first sensor being disposed between the preliminary registration datum and the delivery registration datum;

wherein the auxiliary nip assembly moves into an open position in response to the first signal from the first sensor indicating the portion of the sheet being disposed between the preliminary registration datum and the delivery registration datum.

3. The apparatus of claim 1, wherein the auxiliary nip assembly moves into the closed position subsequent to moving into the open position.

4. The apparatus of claim 1, further comprising:

one of the first and second sensors being disposed adjacent the sheet registration nip assembly;

wherein the auxiliary nip assembly moves into the closed position prior to a trailing edge of the sheet passing the sheet registration nip assembly, in response to a signal from the sensor indicating the location of the trailing edge of the sheet.

5. The apparatus of claim 1, wherein the delivery registration datum coincides with a sheet capture point of a next downstream transfer station.

6. An apparatus for registering a sheet moved in a process direction along a transport path in a media handling assembly, a lateral direction extending perpendicular to the process direction, the apparatus comprising:

a sheet registration nip assembly for changing characteristics of the sheet with respect to the transport path, the characteristics of the sheet including at least one of a skew position, process direction position and a lateral position of the sheet, wherein a delivery registration datum is disposed downstream of the sheet registration nip assembly, the sheet registration nip assembly changing a first sheet characteristic to a first target characteristic, the first target characteristic imparted on the sheet by the time the sheet reaches a preliminary registration datum, the sheet registration nip assembly changing a second sheet characteristic to a second target characteristic, the second sheet characteristic changed when at least a portion of the sheet is disposed along the transport path between the preliminary registration datum and the delivery registration datum;

a first sensor measuring the first sheet characteristic at a first point along the transport path, wherein at the first point the sheet being disposed substantially upstream along the transport path of the sheet registration nip assembly;

a second sensor measuring the second sheet characteristic at a second point along the transport path, the second sensor measuring a portion of the sheet disposed downstream along the transport path of the sheet registration nip assembly; and an auxiliary nip assembly disposed laterally adjacent the second sensor, the preliminary registration datum being coincident with the second point.

7. The apparatus of claim 6, further comprising:

an element biasing the auxiliary nip assembly selectively into one of an open and a closed position; and a first sensor disposed between the preliminary registration datum and the delivery registration datum;

wherein the auxiliary nip assembly moves into an open position in response to a first signal from the first sensor indicating the portion of the sheet being disposed between the preliminary registration datum and the delivery registration datum.

8. The apparatus of claim 7, further comprising:

a second sensor;

wherein a second signal from one of the first and second sensors indicates a length of the sheet exceeds a predetermined value.

9. The apparatus of claim 6, further comprising:

an element biasing the auxiliary nip assembly selectively into one of an open and a closed position;

wherein the auxiliary nip assembly moves into the closed position subsequent to moving into the open position.

10. The apparatus of claim 6, further comprising:

an element biasing the auxiliary nip assembly selectively into one of an open and a closed position; and a sensor disposed adjacent the sheet registration nip assembly;

wherein the auxiliary nip assembly moves into the closed position prior to a trailing edge of the sheet passing the sheet registration nip assembly, in response to a signal from the sensor indicating the location of the trailing edge of the sheet.

11. The apparatus of claim 6, wherein the delivery registration datum coincides with a sheet capture point of a next downstream transfer station.

12. A method of registering a sheet moved substantially in a process direction along a transport path in a media handling assembly, a lateral direction extending perpendicular to the process direction, the method comprising:

providing a first sensor to measure a first sheet characteristic;

transmitting a first signal from the first sensor to a sheet registration nip assembly to change the first sheet characteristic to a first target characteristic, wherein sheet characteristics include at least one of sheet skew position, sheet process direction position and sheet lateral position relative to the sheet registration nip assembly, the sheet substantially achieving the first target characteristic at least by the time the sheet reaches a preliminary registration datum, the preliminary registration datum disposed along the transport path between an auxiliary nip and the sheet registration nip assembly, wherein the auxiliary nip assembly and a delivery registration datum are disposed downstream of the sheet registration nip assembly;

providing a second sensor laterally adjacent the auxiliary nip assembly to measure a second sheet characteristic at a second point along the transport path, the preliminary registration datum being coincident with the second point;

receiving a second sheet characteristic information signal from the second sensor, the second sheet characteristic information signal being received after at least a portion of the sheet is disposed along the transport path between the preliminary registration datum and the delivery registration datum; and transmitting the second signal to the sheet registration nip assembly to change a second sheet characteristic to a second target characteristic.

13. The method of claim 12, wherein the first signal is received from the first sensor for measuring characteristics of the sheet at a first point along the transport path, wherein at the first point the sheet is disposed substantially upstream along the transport path of the sheet registration nip assembly, wherein the second signal is received from the second sensor for measuring characteristics of the sheet at a second point along the transport path, the second point disposed downstream along the transport path of the auxiliary nip assembly.

14. The method of claim 12, wherein the first signal from the first sensor is transmitted to impart the first target characteristic to the sheet by the time the sheet reaches the delivery registration datum.

15. The method of claim 12, further comprising:

providing a third sensor to measure a third sheet characteristic;

sending a third signal from one of the second and third sensors; and transmitting the third signal to the auxiliary nip assembly, thereby actuating the auxiliary nip assembly to move into an open position in response to the second signal being transmitted.

16. The method of claim 15, wherein the second signal indicates a length of the sheet exceeds a predetermined value.

17. The method of claim 12, further comprising:

providing a third sensor to measure a third sheet characteristic and send a third signal; and transmitting the third signal to the auxiliary nip assembly, thereby actuating the auxiliary nip assembly to move into a closed position in response to the second signal being transmitted.

18. The method of claim 12, further comprising:

providing a third sensor to measure a third sheet characteristic and send a third signal; and transmitting the third signal to the auxiliary nip assembly, thereby actuating the auxiliary nip assembly to move into a closed position prior to a trailing edge of the sheet passing the sheet registration nip assembly.

19. The method of claim 12, wherein the delivery registration datum coincides with a sheet capture point of a next downstream transfer station.

* * * * *